US012366144B2

(12) United States Patent
Vriend et al.

(10) Patent No.: US 12,366,144 B2
(45) Date of Patent: Jul. 22, 2025

(54) ADDRESSABLE SWITCH WITH INITIATOR DETECTION AND INITIATOR RESISTANCE MEASUREMENT

(71) Applicant: Hunting Titan, Inc.—Pampa, Pampa, TX (US)

(72) Inventors: Timothy Vriend, Houston, TX (US); Sridhar Rajaram, Houston, TX (US)

(73) Assignee: HUNTING TITAN, INC., Pampa, TX (US)

( * ) Notice: Subject to any disclaimer, the term of this patent is extended or adjusted under 35 U.S.C. 154(b) by 501 days.

(21) Appl. No.: 17/778,390

(22) PCT Filed: Nov. 21, 2020

(86) PCT No.: PCT/US2020/061688

§ 371 (c)(1),
(2) Date: May 19, 2022

(87) PCT Pub. No.: WO2021/102384

PCT Pub. Date: May 27, 2021

(65) Prior Publication Data

US 2022/0412195 A1 Dec. 29, 2022

Related U.S. Application Data

(60) Provisional application No. 62/938,794, filed on Nov. 21, 2019, provisional application No. 63/028,151, filed on May 21, 2020.

(51) Int. Cl.

| | |
|---|---|
| ***F23Q 7/00*** | (2006.01) |
| ***E21B 43/1185*** | (2006.01) |
| ***F42D 1/05*** | (2006.01) |

(52) U.S. Cl.
CPC ..... *E21B 43/1185* (2013.01); *F42D 1/05* (2013.01)

(58) Field of Classification Search
CPC ..... E21B 43/1185; F42D 1/05
USPC ..... 361/251
See application file for complete search history.

(56) References Cited

U.S. PATENT DOCUMENTS

| | | | | |
|---|---|---|---|---|
| 3,611,023 | A * | 10/1971 | Souza, Jr. | H03K 17/52 102/202.7 |
| 5,700,969 | A * | 12/1997 | Mosley | E21B 43/1185 102/312 |
| 5,747,936 | A * | 5/1998 | Harrison | H01J 37/3171 315/111.81 |
| 6,300,764 | B1 * | 10/2001 | Kelley | G01R 31/2829 340/514 |
| 7,565,927 | B2 | 7/2009 | Gerez et al. | |
| 8,695,506 | B2 * | 4/2014 | Lanclos | F42D 1/055 102/206 |
| 9,395,394 | B2 | 7/2016 | Hori et al. | |
| 2004/0108114 | A1 * | 6/2004 | Lerche | E21B 47/12 166/302 |

(Continued)

FOREIGN PATENT DOCUMENTS

| | | |
|---|---|---|
| CN | 203629462 U | 6/2014 |
| WO | 2011014891 A2 | 2/2011 |
| WO | 2011014892 A2 | 2/2011 |

*Primary Examiner* — Jared Fureman
*Assistant Examiner* — Lucy M Thomas
(74) *Attorney, Agent, or Firm* — Troutman Pepper Locke LLP; Joshua L. Jones

(57) ABSTRACT

A method and apparatus for electrically detecting the presence of an initiator in a downhole tool.

15 Claims, 7 Drawing Sheets

(56) References Cited

U.S. PATENT DOCUMENTS

| | | | | |
|---|---|---|---|---|
| 2005/0045331 | A1* | 3/2005 | Lerche | E21B 41/00 166/55 |
| 2007/0125540 | A1 | 6/2007 | Gerez et al. | |
| 2013/0066575 | A1 | 3/2013 | Hori et al. | |
| 2017/0327068 | A1 | 11/2017 | Phillion et al. | |
| 2019/0032470 | A1* | 1/2019 | Harrigan | E21B 17/028 |
| 2019/0190510 | A1 | 6/2019 | Smith et al. | |

* cited by examiner

ADDRESSABLE SWITCH WITH INITIATOR DETECTION AND INITIATOR RESISTANCE MEASUREMENT

RELATED APPLICATIONS

This application claims priority to U.S. Provisional Application No. 62/938,794, filed Nov. 21, 2019 and U.S. Provisional Application No. 63/028,151, filed May 21, 2020.

BACKGROUND OF THE INVENTION

In the downhole oil and gas perforating environment, initiators such as detonators, igniters, etc. are used in conjunction with electronics ("switch") to: perforate the well/casing, set plugs, and release tool-strings. The switch is responsible for isolating voltage from the initiator until initiation is desired. The initiators are checked for integrity on surface before they are deployed with the switch downhole. Once they are downhole, there is no way of validating whether the switch-initiator combination is still usable. There is a need to verify that the initiator is still intact and will function as intended when deployed downhole after it is attached to the switch. A common failure in perforating tools is an open-circuit initiator. Open circuits can be due to an issue with the initiator itself or an issue with the wiring between the initiator and the switch. One of the main indicators of a faulty initiator is its resistance. A resistance measurement can indicate a short-circuit initiator, an open-circuit initiator, or an initiator with an incorrect resistance value. Being able to measure the resistance of the initiator by using the switch will reduce the chance of misruns downhole.

BRIEF SUMMARY OF THE INVENTION

In switches that use low-side switching devices to fire the initiator, this invention adds the ability to detect whether the initiator is closed circuit or open circuit. By adding a high-impedance current path in parallel to the switching device(s) used to fire the initiator, a small current may be generated through the initiator. This current may be detected by some additional circuitry to verify the presence of the initiator.

By applying an electrical current to the initiator, the induced voltage across it can be used to calculate its resistance. This voltage can be measured by an ADC (Analog to Digital Converter) or similar device. To ensure safety, the current applied to the initiator is kept much less than its "no-fire" current. While measuring the initiator, it is kept isolated from the switch's supply voltage (wireline voltage) by devices such as transistors or diodes. While firing the initiator, devices such as transistors or diodes isolate the measurement circuitry from the voltage induced in the initiator.

An example embodiment may include a perforating gun system comprising a cylindrical housing with a bottom end and a top end, a prewired loading tube assembly disposed within the cylindrical housing and having a corresponding bottom end and top end, an upper end fitting coupled to the top end of the prewired loading tube and the top end of the cylindrical housing, a lower end fitting coupled to the bottom end of the prewired loading tube and the bottom end of the cylindrical housing, an upper electrical connections coupled to the upper end fitting, a lower electrical connections coupled to the bottom end fitting, an initiator electrically coupled to the selective switch and further disposed within the upped end fitting, an initiator voltage isolation switch in series with the initiator and a common ground, coupled to a detonator connector receptacle disposed within the upper end fitting, a current limiter in series with the initiator, and a current detection circuit in series with the current limiter and is grounded to the common ground, wherein the initiator voltage isolation switching device is electrically parallel with the series of the current limiter and the current detection circuit.

A variation of the example embodiment may include the upper end fitting being disposed within the pre-wired loading tube housing a selective switch wherein the end fitting contains a portion to receive an auto-shunting modular detonator by electrically connecting it to a mating receptacle of a selective switch and affixing the auto-shunting modular detonator proximate to a detonating cord. It may include a means for auto-shunting the detonator. It may include coupling a baffle to the bottom end of the cylindrical housing. It may include the prewired loading tube further comprises an insulated wire which is terminated at the selective switch in the upper end and a pressure bulkhead coupled to the lower end. The selective switch may be grounded to the loading tube. The loading tube may be electrically connected to the baffle. It may include the shaped charges being installed into the loading tube, wherein the shaped charges are held in place by a locking means fixed to the shaped charge. It may include a detonating cord coupled to the back of the shaped charges with a detonating cord locking means. The detonating cord may terminate into a detonating cord orifice integral with the end fitting. The detonator may be located adjacent to the detonating cord in an end-to-end configuration. The detonator may have an auto-shunting feature that does not un-shunt until a mating receptacle is inserted. The selective switch may have a ribbon pigtail with the un-shunting receptacle attached. The receptacle may be connected to the switch and is further attached to the end of the detonator, disengaging the shunt of the detonator.

An example embodiment may include a method of perforating a wellbore comprising coupling a pre-wired first end fitting with a first end of a shaped charge loading tube, coupling a pressure bulkhead at the first end fitting and the first end of the shaped charge loading tube, coupling a pre-wired second end fitting with a second end of a shaped charge loading tube, wherein the second end fitting centers and orients the loading tube and embodies an initiator electrically coupled to a selective switch and further disposed within the upped end fitting, wherein an initiator voltage isolation switch is in series with the initiator and a common ground, coupled to a detonator connector receptacle disposed within the upper end fitting, a current limiter in series with the initiator; and a current detection circuit in series with the current limiter and is grounded to the common ground, wherein the initiator voltage isolation switching device is electrically parallel with the series of the current limiter and the current detection circuit, and pre-wiring the loading tube with insulated wire, wherein the wire terminates at the selective switch in the second end fitting and the pressure bulkhead at the first end fitting.

A variation may include centering the loading tube using the first end fitting within a perforating gun body. It may include electrically contacting the pre-installed insulated wire disposed within the loading tube to the pressure bulkhead contact adjacent. It may include pre-installing the baffle in the pin end of the gun carrier. It may include grounding the selective switch to the shaped charge loading tube. It may include inserting the shaped charges into the shaped charge loading tube. It may include locking the shaped charges into place within the shaped charge loading tube. It may include inserting detonating cord into the back of each shaped charge disposed within the shaped charge loading tube via locking features fixed to the shaped charge. It may include inserting the termination of a detonating cord into the end fitting. It may include inserting a wireless detonator into the end fitting from outside of the perforating gun assembly such that the explosive load end of the detonator is adjacent to the detonating cord in an end to end position. The wireless detonator may have an auto-shunting feature that does not un-shunt until a mating receptacle is inserted. It may include inserting the wireless detonator, which disengages the shunt of the detonator. It may include screwing together the loaded perforating modular gun assemblies wherein the top contact makes electrical contact to the bottom contact of the adjacent gun assembly. It may include swaging and threading the outer diameter of a pin end of the perforating gun. It may include installing a pin by pin tandem sub into a box end of perforating gun assembly having a box by box gun body. It may include selectively initiating the detonator of the perforating gun. It may include pre-assembling spring-loaded top contact wires coupled to the selective switch. It may include connecting the through wire of the selective switch to the insulated wire of the loading tube. It may include inserting the detonating cord through the inner end of the end fitting and a detonator from the outer end such that the detonator is adjacent to the detonating cord on the horizontal axis of the gun body. It may include overlapping the detonating cord and the detonator to form a side by side explosive coupling. It may include installing the pressure bulkhead into the baffle of the pin end of the gun carrier. It may include coupling the pressure bulkhead into a pin-by-pin tandem sub, wherein the tandem sub is inserted into the first end of the gun carrier. It may include coupling the pressure bulkhead into the second end of the gun carrier. It may include arming the perforating gun by inserting a wireless electric detonator, connector end facing up, into the end fitting detonator orifice. It may include attaching the selective switch to the pre-wired loading tube and wiring the detonator connector receptacle pass through to the upper end fitting. It may include connecting the insulated wire to the switch within the lower end fitting, wherein the detonator connector receptacle wire runs the length of the loading tube and the receptacle end passes through the upper end fitting.

An example embodiment may include an apparatus for detecting current through an initiator in a perforating gun string comprising an initiator coupled to an electrical source, an initiator voltage isolation switch in series with the initiator and a common ground, a current limiter in series with the initiator, a current detection circuit in series with the current limiter and is grounded to the common ground, wherein the initiator voltage isolation switching device is electrically parallel with the series of the current limiter and the current detection circuit.

A variation of the example embodiment may include the initiator detonating a perforating gun. It may include the current limiter further having a plurality of resistors in series. The current detection circuit may further include a resistor in parallel with a Zener diode, wherein the current measured across the resistor is sent to the surface for analysis. The current detection circuit may include a plurality of resistors in series.

An example embodiment may include a method for detecting current through an initiator comprising supplying current to the initiator, wherein the supplied current is less than the current necessary to initiate the initiator, detecting whether current is flowing through the initiator, and toggling a digital input of a switch corresponding to whether or not current is detected flowing through the initiator.

A variation of the example embodiment may include initiating the initiator. It may include determining whether or not an initiator is present. It may include sending a signal to a surface location corresponding to the measured current. It may include testing the initiator with a supplied current that is less than the no-fire current of the initiator. It may include isolating the initiator from a power source.

An example embodiment may include a method for measuring the resistance of an initiator comprising electrically isolating the initiator from a power source, supplying current to the initiator, wherein the supplied current is less than the current necessary to initiate the initiator, detecting voltage through the initiator, and calculating the resistance of the initiator.

A variation of the example embodiment may include initiating the initiator, sending the measured voltage to a surface location, sending the calculated resistance of the initiator to a surface location, determining whether the initiator is functioning correctly using the calculated resistance of the initiator, determining whether the initiator is shorted using the calculated resistance of the initiator, determining whether the initiator is present using the calculated resistance of the initiator, or testing the initiator using the calculated resistance of the initiator.

An example embodiment may include an apparatus for detecting an open circuit initiator in a perforating gun string comprising an initiator, wherein the initiator is coupled to a current limiter, a voltage isolation device, wherein the voltage isolation device isolates the initiator from a power source and is in parallel with the current limiter, and a current detection device coupled to the aforementioned current limiter, wherein the current detection device detects the current across the initiator and determines whether the initiator is an open-circuit or a closed circuit.

A variation of the example embodiment may include having the current supplied to the initiator by the current limiter being less than the current necessary to initiate the initiator. It may include a switch, wherein the switch is capable of initiating the initiator. The current limiter may be a plurality of resistors in series. The current detection device may be a resistor in parallel with a digital input. The switch, upon receiving a signal from an operator at a surface location, may detect the current through the initiator and transmit the detection back to the operator.

An example embodiment may include an apparatus for detecting current through an initiator comprising an initiator in series with a high-impedance resistive divider, the high impedance resistive divider further comprising a plurality of resistors in series that are in parallel with a low side initiator voltage isolation switching device, wherein the initiator voltage isolation switching device allows a small amount of electrical current to flow through the initiator and the resistive divider can toggle a digital input of the switch's MCU between high (on) or low (off) depending on the current detection device detecting current passing through the initiator.

A variation of the example embodiment may include the value for the plurality of resistors summing to 9.9 MΩ. The initiator current may be 50 μA at 500 volts. It may provide high voltage protection to the current detection device using a clamping Zener diode. It may provide high voltage protection to the current detection device using a rectifier diode directing current into a voltage rail. It may provide high voltage protection to the current detection device by changing a digital input into a digital output while high voltage is expected to be present on the initiator voltage isolation switching device. It may include an electrically shunt coupled to the initiator voltage isolation switching device. The shunting may be accomplished using a depletion-mode MOSFETs turned on and off by a microcontroller. The microcontroller may be supplied with power from a wellsite.

An example embodiment may include an apparatus for measuring the resistance of an initiator in a perforating gun string comprising an initiator coupled to a current limiter through a voltage isolation device, a voltage isolation device which isolates the initiator from a power source, and a voltage measurement device coupled to the initiator through a voltage isolation device wherein the measured voltage is used to calculate the resistance of the initiator.

A variation of the example embodiment may include a switch, wherein the switch is responsible for initiating the initiator. The current limiter may include a resistor, wherein the resistor has a relatively large resistance compared to the initiator's resistance, and a constant voltage source. The voltage induced across the initiator may be used to measure/calculate the resistance of the initiator. The calculated resistance of the initiator may determine whether the initiator is functioning correctly. The calculated resistance of the initiator may determine whether the initiator is shorted. The calculated resistance of the initiator may determine whether the initiator is present. The calculated resistance of the initiator may test the initiator. The switch, upon receiving a signal from an operator at a surface location, may measure the resistance of the initiator and transmit the measured resistance back to the operator. The supplied current to the initiator may be less than the no-fire current of the initiator.

An example embodiment may include an apparatus for detecting an open circuit initiator in a perforating gun string comprising an initiator, wherein the initiator is coupled to a current limiter, a voltage isolation device, wherein the voltage isolation device isolates the initiator from a power source and is in parallel with the voltage isolation device, and a current detection device coupled to the aforementioned current limiter, wherein the current detection device detects the current across the initiator and determines whether the initiator is an open-circuit or a closed circuit.

A variation of the example embodiment may include the current being supplied to the initiator by the current limiter being less than the current necessary to initiate the initiator. It may include a switch, wherein the switch is capable of initiating the initiator. The current limiter may be a plurality of resistors in series. The current detection device may be a resistor in parallel with a digital input. The switch, upon receiving a signal from an operator at a surface location, may measure the resistance of the initiator and transmit the measured resistance back to the operator.

DETAILED DESCRIPTION OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

Figure 1:
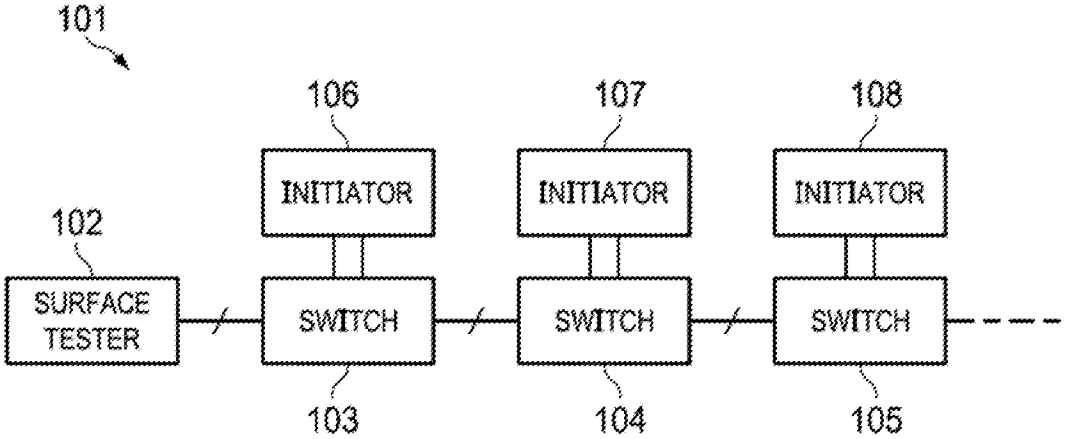
FIG. 1 shows a surface tester which can interface with switches to check the health of an individual switch or the toolstring as a whole. This surface tester can show the measured resistance of the initiator or give a warning if it is out of a set range.

This invention provides a way to detect a fault such as an open-circuit or absent initiator by a switch which uses a low-side switching device(s) to fire the initiator. An example embodiment 101 is shown in FIG. 1 with a surface tester 102 coupled to switches 103, 104, and 105. Each switch is paired with a respective initiator 106, 107, and 108.

Figure 2:
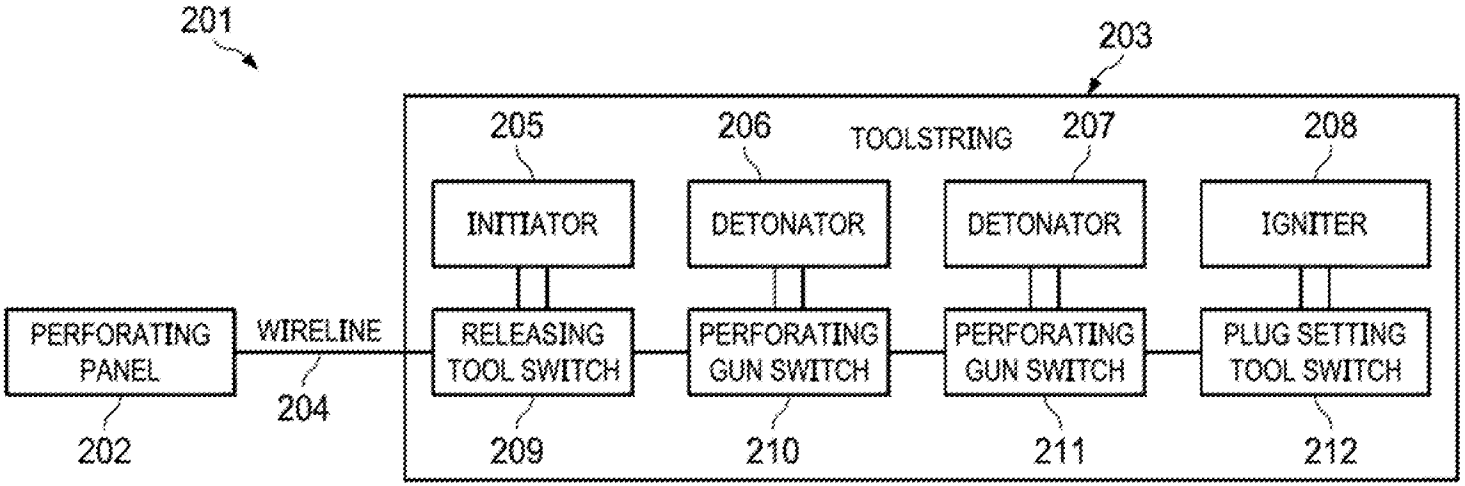
FIG. 2 shows a perforating panel interfacing with a toolstring comprised of a releasing tool, perforating guns, and a plug setting tool.

An example embodiment 201 shown in FIG. 2 shows a perforating panel 202, located at the surface, and is electrically coupled to a gun string 203 via wireline 204. The gun string 203 includes a releasing tool switch 209 coupled to an initiator 205 associated with a releasing tool. The gun string 203 includes a perforating gun switch 210 coupled to a detonator 206 associated with a first perforating gun. The gun string 203 includes a perforating gun switch 211 coupled to a detonator 207 associated with a second perforating gun. The gun string 203 includes a plug setting tool switch 212 coupled to an igniter 208 associated with a plug setting tool.

Figure 3:
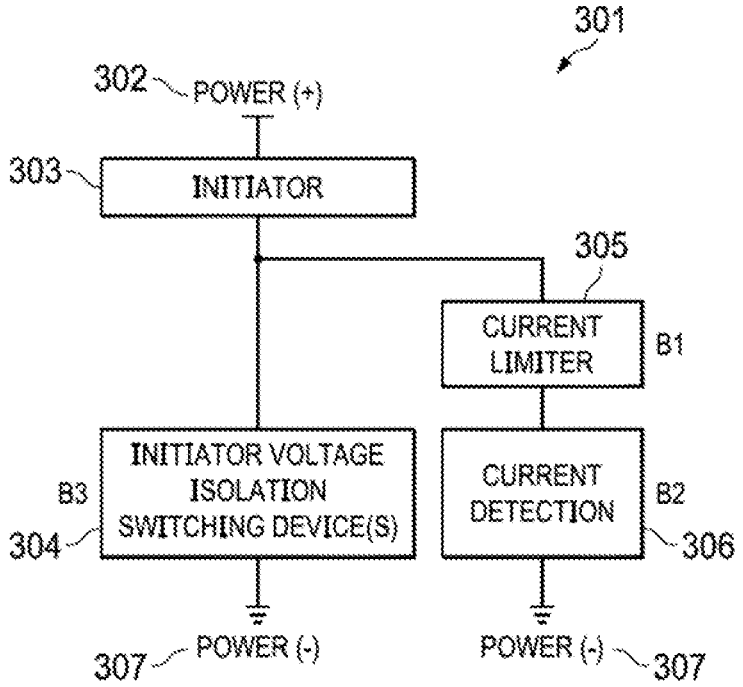
FIG. 3 shows the block diagram of an example embodiment. Designators B1, B2, and B3 will be used to reference the blocks of this diagram.

An example embodiment 301 is shown in FIG. 3 of a block diagram of the circuit. Power 302 is provided from the surface to the initiator 303. A current limiter, B1, 305 is in series with a current detection, B2, 306 between the initiator 303 and the ground 307. Initiator voltage isolation switching devices, B3, 304, between the initiator 303 and the ground 307.

Current limiter B1, 305 is a high impedance device(s) placed in parallel with the low-side initiator voltage isolation switching device(s), B3, 304 to allow a small amount of electrical current to flow from the positive voltage rail 302, through the initiator 303, into a current-detection circuit, B2, 306. If the initiator 303 is missing or open circuit, no current will flow, and the current detection circuit, B2, 306, will not detect any current. The total impedance of current limiter, B1, 305 must be chosen such that the current drawn through the initiator 303 remains much less than its rated "no-fire" current, even when the switch is exposed to its maximum rated voltage. Current limiter, B1, 305 can be any kind of current limiter such as a constant-current source or a simple resistor. The detection circuitry of current detection circuit, B2, 306, can be an analog measurement circuit such as an ADC (Analog to Digital Converter) or a digital input such as the base/gate of a transistor. If using a voltage-dependent input such as a CMOS digital input or an ADC, the current through current limiter, B1, 305 must be passed through another resistor to generate a detectable voltage.

Using an ADC input theoretically allows one to measure the resistance value of the initiator 303 if using resistors for current limiting and detection. This is extremely challenging due to the difference in value between current limiter, B1, 305 and the initiator 303. Resistor temperature coefficient, part tolerance, and ADC resolution can make this method challenging.

To measure the resistance of the initiator 303, a test-current is applied to it. Applying current to a resistive element generates a voltage. This generated voltage is proportional to both the resistance of the element and the current applied to it. Assuming one knows the test-current applied to the resistance, one can calculate the resistance from the voltage measured.

Figure 4:
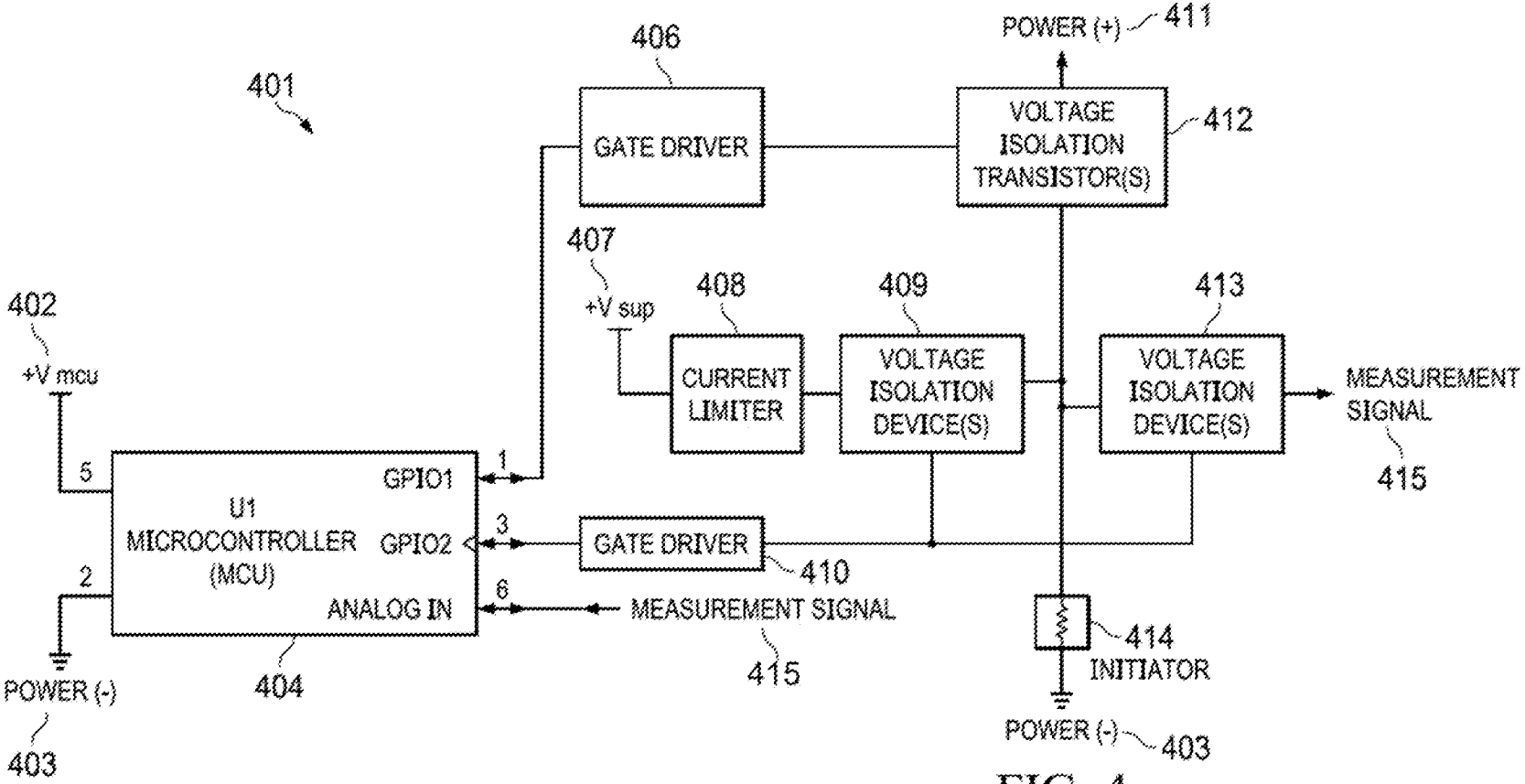
FIG. 4 depicts the block diagram of an example embodiment including electronics on the switch.

An example embodiment 401 shown in FIG. 4 includes a microcontroller 404 receiving power 402 and grounded 403. The microcontroller 404 is coupled to gate driver 406 which is then coupled to voltage isolation transistor(s) 412. Microcontroller 404 is coupled to gate driver 410 which is further coupled to voltage isolation device(s) 413. Current limiter 408 is supplied by voltage 407 and is coupled to voltage isolation device(s) 409. Power 411 is coupled to voltage isolation transistor(s) 412 which are coupled to voltage isolation device(s) 409 and 413, and further coupled to initiator 414, which is coupled to ground 403. Voltage isolation device(s) 413 outputs a measurement signal 415. The microcontroller 404 receives measurement signal 415.

Figure 5:
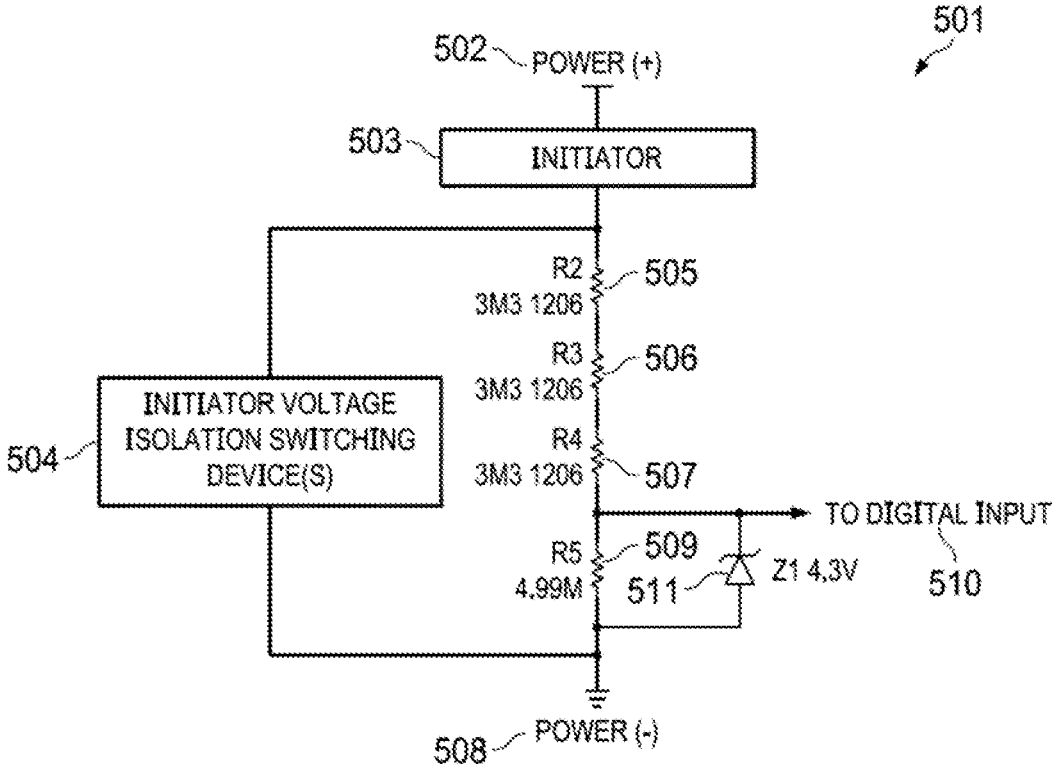
FIG. 5 is the implementation off an example embodiment. Designators R1, R2, D1, etc. will be used to reference the components of this schematic.

The most cost-effective method of this example embodiment 501, shown in FIG. 5, is to form a very high-impedance resistive divider which can toggle a digital input of the switch's MCU between high (on) or low (off) depending on the presence of the initiator 503. Power 502 is supplied to the initiator 503. Current limiter, Resistors R1, 505, R2, 506, and R3, 507, is placed in parallel with the low-side initiator voltage isolation switching device(s), 504 to allow a small amount of electrical current to flow from the positive voltage rail 502, through the initiator 503, into a current-detection circuit of resistor 509, Zener Diode 511, and digital input 510. The current detection circuit and the initiator voltage isolation switching device(s) are terminate to ground 508. In this method, the divider toggles the digital input to be high while the initiator 503 is present and low while the initiator is missing. Resistor R4 509 ensures the digital input is pulled low and does not float when the initiator 503 is missing. The ratio of the resistance of the current limiter (resistors R1, 505, R2, 506, and R3, 507) and resistor R4, 509 must be chosen such that the digital input can be pulled high when using low-voltage communication with the switches. A single resistor could be used for the current limiter (B1) but separating the resistor into multiple devices adds redundant safety. The values shown for resistors R1, 505, R2, 506, and R3, 507 create a sum of 9.9 MΩ, which leads to a leakage current of about 50 μA while 500 V is applied to the switch.

Some form of voltage protection should be given to the digital input 510 to prevent high voltage from causing damage to the sensitive circuitry. A clamping Zener diode 511 or a rectifier diode directing current into a voltage rail can offer protection. Another protection method for a GPIO input is to change the digital input into a digital output while high voltage is expected to be present on the switch.

This method of resistance measurement still allows for initiator safety devices such as electronic shunts on the switch. Possible electronic shunts include depletion-mode MOSFETs which can be turned on and off by the microcontroller.

Figure 6:
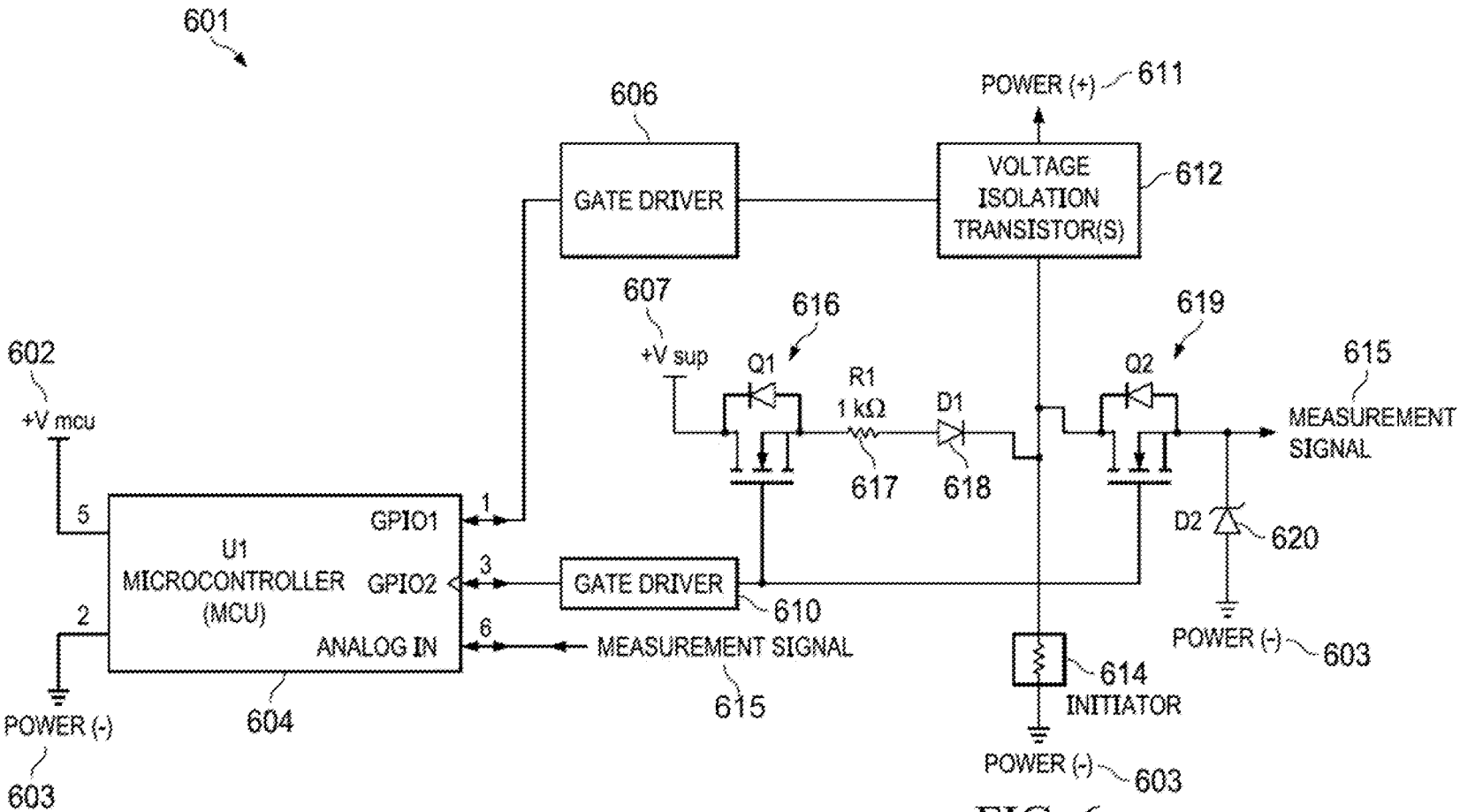
FIG. 6 shows an implementation of measuring the initiator's resistance. Designators in this figure such as U1, Q1, R1, etc. will be used to reference those particular parts in the detailed description.

An example embodiment 601 is shown in FIG. 6. It includes a microcontroller 604 receiving power 602 and grounded 603. The microcontroller 604 is coupled to gate driver 606 which is coupled to voltage isolation transistor(s) 612. Microcontroller 604 is coupled to gate driver 610 which is further coupled to MOSFET Q1, 616, which is supplied by voltage 607 and is further coupled to resistor R1, 617 and diode D1, 618, and then further coupled to voltage isolation transistor(s) 612. Power 611 is coupled to voltage isolation transistor(s) 612. Initiator 614 is coupled to ground 603. The coupling between voltage isolation transistor(s) 612 and initiator 614 is further coupled to MOSFET Q2, 619, which is coupled to gate driver 610 and generates a measurement signal 615. Diode D2 620 coupled the measurement signal 615 with the ground 603. The microcontroller 604 receives measurement signal 615.

By using the implementation shown in FIG. 6, we can show how the resistance can be measured.

The voltage generated across the initiator is defined by Ohm's law as:

$$V_{INIT}=I_{INIT}*R_{INIT} \quad \text{EQN 1)}$$

Where, $V_{INIT}$=Voltage across Initiator $I_{INIT}$=Current through the Initiator $R_{INIT}$=Resistance of the Initiator $I_{INIT}$ is calculated based on the resistance $R_{INIT}$, the voltage supplied for the measurement, and the components MOSFET Q1 616, resistor R1 617, and diode D1 618.

$$I_{INIT}=(V_{Sup}-V_{D1})/(R_{QION}+R_{R1}+R_{INIT}) \quad \text{EQN 2)}$$

Where, $V_{Sup}$=Voltage supplied for the resistance measurement $V_{D1}$=Voltage across D1

$R_{R1}$=Resistance of resistor R1

$R_{QION}$=Resistance of Q1's drain to source while Q1 is on

Plugging EQN 2 into EQN 1 for $I_{INIT}$ gives us the following equation:

$$V_{INIT}=((V_{Sup}-V_{D1})/(R_{QION}+R_{R1}+R_{INIT}))*R_{INIT} \quad \text{EQN 3)}$$

Rearranging eqn 3 to solve for $R_{Init}$ gives:

$$R_{INIT}=-V_{INIT}*(R_{R1}-R_{QION})/(V_{INIT}V_{Sup}+V_{D1}) \quad \text{EQN 4)}$$

By selecting a MOSFET Q1 with an on-resistance much less than the resistance value of R1, we can simplify the equation to:

$$R_{INIT}=-V_{INIT}*R_{R1}/(V_{INIT}-V_{Sup}+V_{D1}) \quad \text{EQN 5)}$$

The reverse polarity protection diode, D1 618, adds a nonlinearity to the measurement equation based on the value of the test current. To avoid this nonlinearity, we must produce a known constant current to which the diode produces a known voltage drop. To create this constant current, resistor R1 617 must be much larger than $R_{INIT}$. Since most common initiators have a nominal resistance around 50Ω, choosing a value of 1 kΩ for resistor R1 617 satisfies this requirement.

The regulator which creates $V_{Sup}$ is chosen such that the voltage is stable and accurate. With these variables made relatively constant under these constraints, the solution can be obtained. To implement this calculation of $R_{INIT}$, the induced voltage $V_{INIT}$ must first be measured. By using an ADC (Analog to Digital Converter), $V_{INIT}$ may be digitized and then used in calculations by the switch's MCU or by a computing device connected to the switch. In this example, the ADC is integrated in the MCU, but a discrete ADC or digitizing device will work as well.

To minimize the chance of excessive power being delivered to the initiator, a small current $I_{INIT}$ is chosen which is well below the listed "no-fire" current of the initiator. This is accomplished by choosing $V_{Sup}$ and $R_{R1}$ which will produce a small but still usable $I_{Init}$ current. With a 50Ω initiator, the circuit in FIG. 6 produces an $I_{Init}$ of around 4.5 mA.

An additional effort to minimize the effective power delivered to the initiator is to only expose the initiator for a short duration of time. The duration of applied power is only long enough to acquire the ADC sample(s).

Protecting the measurement circuit from high voltage while firing the initiator is accomplished by devices such as diode D1 618 and MOSFET Q2 619, which remain off while firing is taking place. Diode D1 618 could be replaced by a MOSFET or similar device to improve linearity and accuracy at the cost of complexity. Further protection is given to the microcontroller by diode D2 620 in the case that MOSFET Q2 619 fails.

This method of resistance measurement still allows for initiator safety devices such as electronic shunts on the switch. Possible electronic shunts include depletion-mode MOSFETs which can be turned on and off by the microcontroller.

Initiator detection queries can be added to the normal communication protocol between the surface-tester/perforating-panel and the switch(es). Queries could either be explicitly called by the user to check the initiator's health, or the queries could be part of a routine communication sequence. The detection of the initiator could either be displayed to the user or an alert could be created if it is not detected.

Resistance measurement queries can be added to the normal communication protocol between the surface-tester/perforating-panel and the switch(es). Queries could either be explicitly called by the user to check the initiator's health, or the queries could be part of a routine communication sequence. The measured initiator resistance could either have its value displayed to the user or have an alert be created if the value falls outside a certain threshold.

Figure 7:
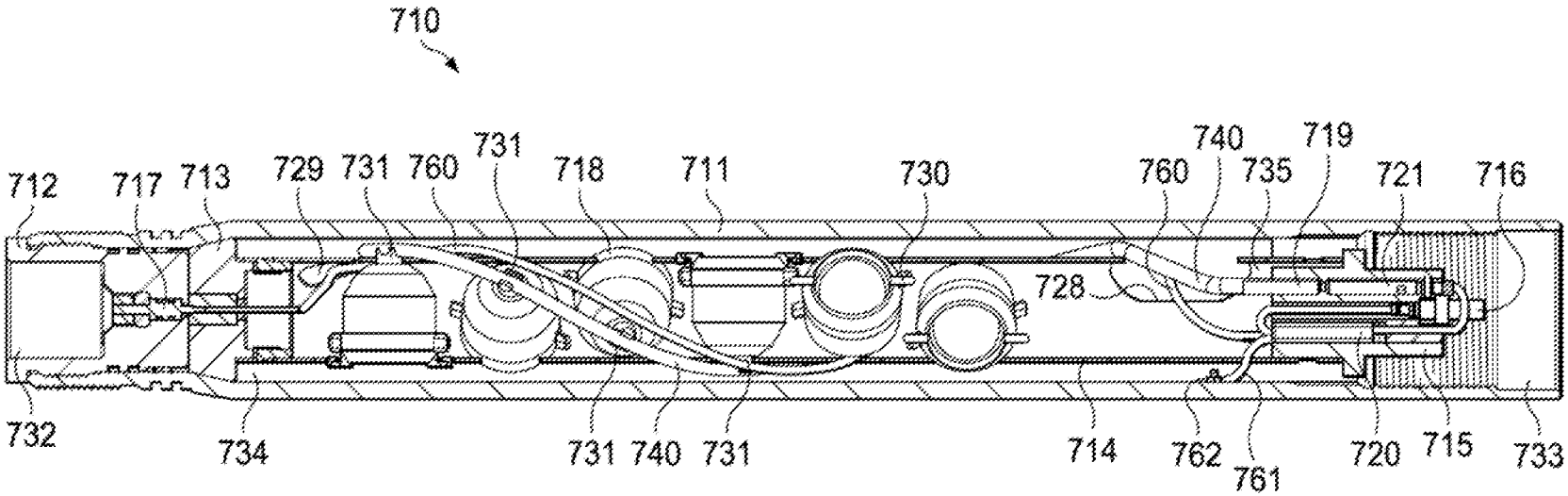
FIG. 7 shows an example embodiment of a modular gun system cross section.

An example embodiment is shown in FIG. 7. The example embodiment includes a perforating gun assembly 710 having a cylindrical body, in this case gun carrier 711, with a lower end 732 and an upper end 733. A baffle 712 with a pressure bulkhead bottom contact 717 disposed therein is further coupled to the lower end 732 of the cylindrical body 711.

A charge tube 714 is loaded with shaped charges 718 and disposed within, and coupled to, the gun carrier 711. In this example embodiment the charge tube 714 is pre-wired. The baffle 712 is adjacent to the bottom end fitting 713 which is coupled to the lower end 734 of the charge tube 714. A charge tube is also known as a loading tube. The charge tube 714 has loading tube cutouts 729 located proximate to the lower end 734 and loading tube cutouts 728 located proximate to the upper end 735. The charge tube 714 has a bottom end fitting 713 located proximate to the lower end 734 and a top end fitting 715 located proximate to the upper end 735. A locking means for shaped charges 718 may include the tabs 730 located on shaped charges 718. A detonator cord locking means may include the retainer fitting 731 located on the end of the shaped charges 718. The selective switch 720 is grounded to the cylindrical body via ground wire 761 coupled to grounding screw 762. Electrical conductor 760 is used to send signals through perforating gun 710 and is pre-wired into the charge tube 714. Electrical conductor 760 is insulated from the cylindrical body 711, which is conductive and acts as a ground. A detonating cord 740 is coupled to each of the shaped charges 718. A ground wire 761 from the selective switch 720 is coupled to the case gun carrier 711 via fastener 762.

Figure 8:
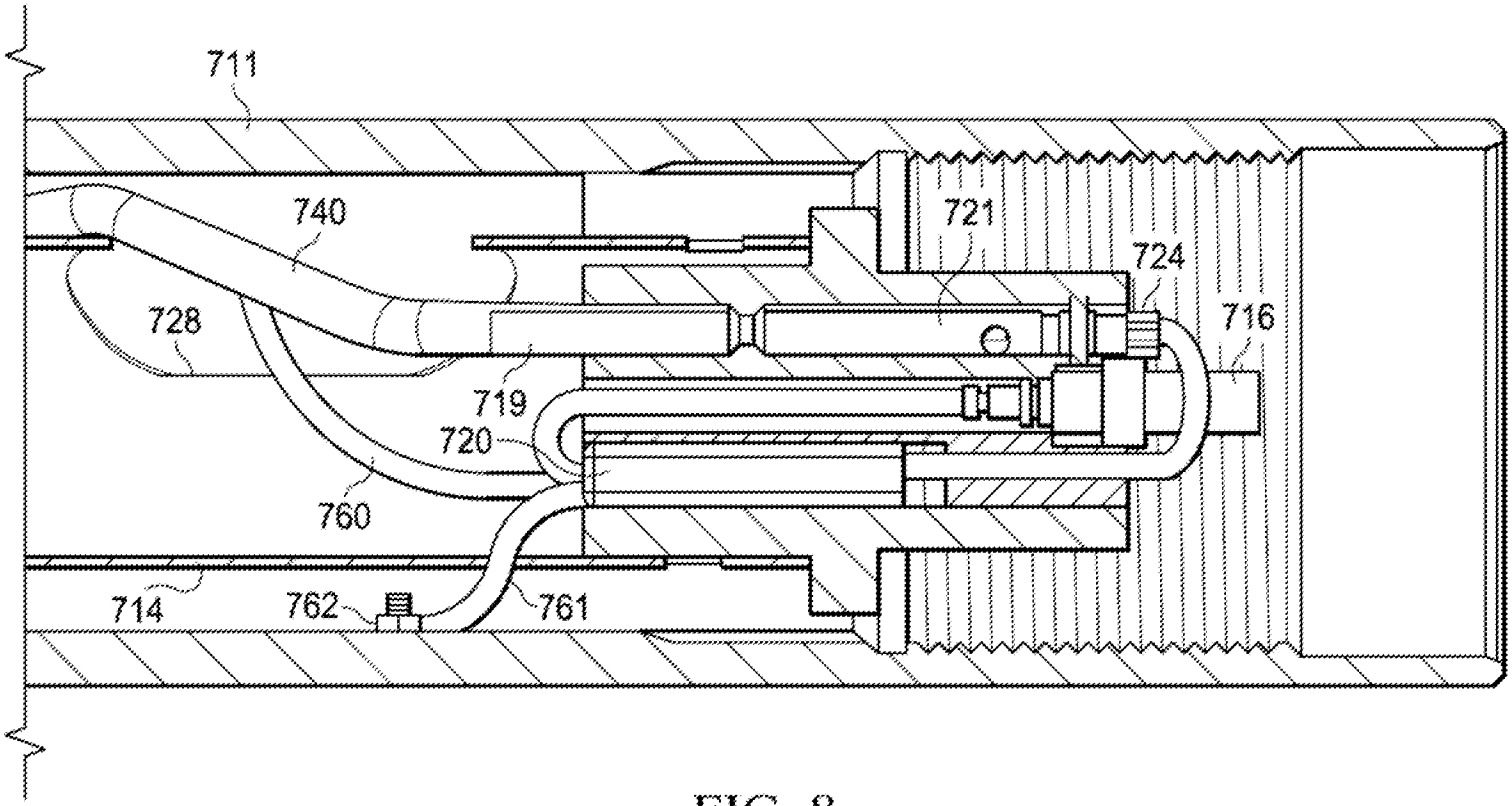
FIG. 8 shows a close up of an example embodiment of the end of a modular gun system cross section.

The top end fitting 715 includes a selective switch 720, a wireless detonator 721, a detonating cord orifice 719, and a top contact 716. A closer view of top end fitting 715 is shown in FIG. 8. A ground lug allows the selective switch to be grounded to the charge tube. The selective switch 720 is connected to the wireless detonator 721 via the detonator connector receptacle 724. The detonator connector receptacle 724 has an auto-shunting feature whereby the wireless detonator 721 is shunted until the correct connector is inserted. A detonating cord 740 wraps around the outside of the charge tube 714, connecting to all of the shaped charges 718 via connectors 731, and terminates within the charge tube 714, through the loading tube cutout 728, and into the detonating cord orifice 719, which is located proximate to the wireless detonator 721. The detonating cord 740 may be located in an end-to-end or side-by-side configuration with the wireless detonator 721.

Figure 9:
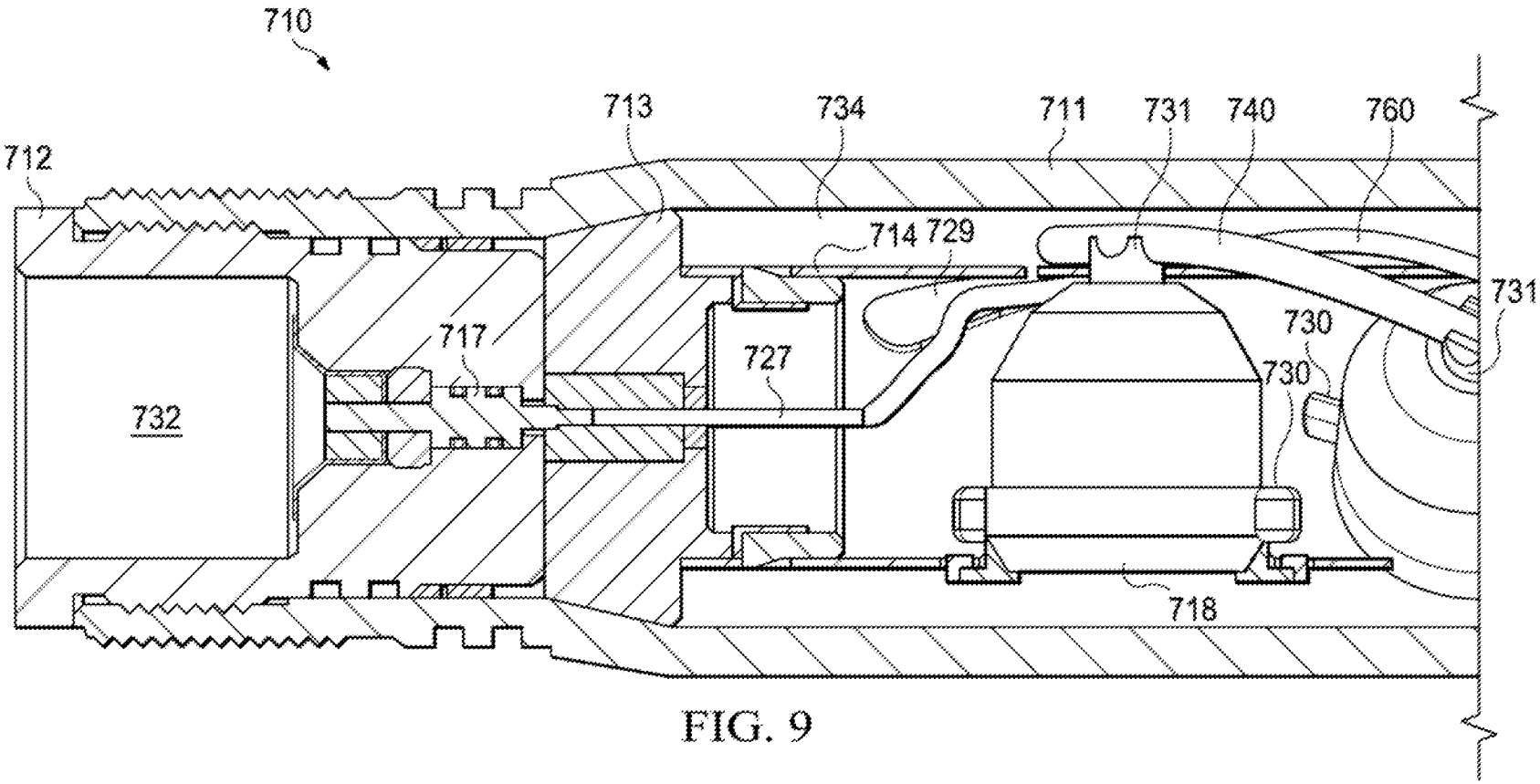
FIG. 9 shows an example embodiment of an end of a modular gun system cross section.

The lower end 732 of the perforating gun assembly 710 is shown in FIG. 9 including a baffle 712 coupled to the lower end 732 and located proximate to the lower end fitting 713. The pressure bulkhead bottom contact 717 is coupled to an insulated wire 727. The loading tube 714 includes shaped charges 718 having locking tabs 730 for locking into the loading tube 714. The shaped charges 718 have detonating cord locking clips 731 that couple to a detonating cord 740 wrapped along the outside of the loading tube 714.

Wireless detonator, as used in this specification, is defined as a detonator that is pre-wired prior to installation and does not require any wiring in the field to function. This wireless capability allows the detonator to become effectively a plug-and-play device that establishes the necessary electrical connections for its function by plugging it into the perforating gun.

The example embodiments disclose a modular gun system that is a box by pin design consisting of a steel loading tube with an end fitting pre-installed at each end. One end fitting centers and orients the loading tube and embodies a selective switch, feed through contact and orifices to insert a wireless detonator from the outer end and detonating cord into the inner end.

The loading tube is pre-wired with insulated wire which is terminated at the selective switch in one end fitting and the pressure bulkhead at the opposite end. The opposite end fitting centers the loading tube and provides electrical contact from the pre-installed insulated wire on the loading tube to the pressure bulkhead contact adjacent to the end fitting. The pressure bulkhead is pre-installed into a baffle in the pin end of the gun carrier. The selective switch is grounded to the loading tube which is electrically connected to the baffle which is threaded into the gun carrier.

Charges are inserted into the loading tube and held in place by locking features fixed to the shaped charge. Detonating cord is inserted into the back of each charge via locking features fixed to the shaped charge. The detonating cord terminates into the detonating cord orifice in the end fitting. A wireless detonator is inserted into the end fitting from outside of the gun assembly such that the explosive load end of the detonator is adjacent to the detonating cord in an end to end position. The wireless detonator has an auto-shunting feature that does not un-shunt until a mating receptacle is inserted.

The selective switch has a ribbon pigtail with the unshunting receptacle attached. After inserting the wireless detonator, the connector receptacle connected to the switch is attached to the end of the detonator, disengaging the shunt of the detonator. The loaded and armed modular gun assemblies are screwed together such that the top contact makes electrical contact to the bottom contact of the adjacent gun assembly. The box by pin gun configuration is accomplished by swaging and threading the outer diameter of one end of the gun. Alternatively, the pin end is accomplished by installing a pin by pin tandem sub into one box end of a box by box gun body.

The end fitting is purposefully designed via a mold or machining method to house a selective switch designed to selectively initiate the detonator of a perforating gun. The end fitting is pre-assembled with a spring-loaded top contact wired to the input of the selective switch. The end fitting is pre-assembled such that the through wire of the selective switch is connected to the insulated wire pre-installed onto the loading tube. The end fitting is pre-assembled such that the output wires of the selective switch are insulated ribbon or wires which has the detonator connector receptacle affixed to its end. The end fitting is purposefully designed via a mold or machining method to insert detonating cord through the inner end and a detonator from the outer end such that the detonator is adjacent to the detonating cord on the horizontal axis of the gun body. Alternatively, the end fitting is designed such that the detonating cord and detonator overlap each other such that the end of the detonating cord and detonator are side by side.

The pressure bulkhead is pre-installed into the baffle of the pin end of the gun carrier. Alternatively, the pressure bulkhead is pre-installed into the pin by pin tandem sub which is inserted into one end of the gun carrier. Alternatively, the pressure bulkhead is pre-installed to the end of the charge tube end fitting. The gun assembly is armed by inserting a wireless electric detonator, connector end facing up, into the end fitting detonator orifice, followed by attaching the connector receptacle attached to the end fitting into the outer end of the detonator.

The selective switch is attached to, or contained within, the pre-wired loading tube and the wires with the detonator connector receptacle pass through the upper end fitting. The selective switch is contained within the lower end fitting, wherein the insulated wire is connected to the switch within the same lower end fitting and the detonator connector receptacle wire runs the length of the loading tube and the receptacle end passes through the upper end fitting.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed:

1. An apparatus for detecting current through an initiator in a perforating gun string comprising:

an initiator coupled to an electrical source;

an initiator voltage isolation switch in series with the initiator and a common ground;

a current limiter in series with the initiator;

a current detection circuit in series with the current limiter and is grounded to the common ground, wherein the initiator voltage isolation switch is electrically parallel with the series of the current limiter and the current detection circuit;

a microcontroller configured to receive and analyze the current detection data from the current detection circuit to determine the status of the initiator;

a Zener diode connected to the current detection circuit to provide overvoltage protection, wherein the initiator voltage isolation switch is a transistor, which is controlled by a surface command signal to selectively isolate or connect the initiator to the electrical source.

2. The apparatus of claim 1, wherein the initiator detonates a perforating gun.

3. The apparatus of claim 1, wherein the current limiter further comprises a plurality of resistors in series.

4. The apparatus of claim 1, wherein the current detection circuit further comprises a resistor in parallel with the Zener diode, wherein the current measured across the resistor is sent to the surface for analysis.

5. The apparatus of claim 1, wherein the current detection circuit further comprises a plurality of resistors in series.

6. The apparatus of claim 1, wherein the current limiter is configured to allow only a predefined range of current that is lower than the initiator's no-fire current, ensuring safe operation during detection.

7. An apparatus for detecting an open circuit initiator in a perforating gun string comprising:

an initiator, wherein the initiator is coupled to a current limiter;

a voltage isolation device, wherein the voltage isolation device isolates the initiator from a power source and is in parallel with the current limiter;

a current detection device coupled to the aforementioned current limiter, wherein the current detection device detects the current across the initiator and determines whether the initiator is an open-circuit or a closed circuit;

a Zener diode connected in parallel with the current detection device to protect the circuit from voltage spikes during operation; and a secondary current limiter in parallel with the voltage isolation device, providing redundant current limiting protection for the initiator during detection operations.

8. The apparatus of claim 7, wherein the switch, upon receiving a signal from an operator at a surface location, detects the current through the initiator and transmits the detection back to the operator.

9. The apparatus of claim 7, wherein the current supplied to the initiator by the current limiter is less than the current necessary to initiate the initiator.

10. The apparatus of claim 7, further comprising a switch, wherein the switch is capable of initiating the initiator.

11. The apparatus of claim 7, wherein the current limiter is a plurality of resistors in series.

12. The apparatus of claim 7, wherein the current detection device is a resistor in parallel with a digital input.

13. The apparatus of claim 7, wherein the current detection device includes an analog-to-digital converter (ADC) for precise measurement of the current flowing through the initiator.

14. The apparatus of claim 7, further comprising an indicator light or display module, which provides a visual signal indicating the open-circuit or closed-circuit status of the initiator.

15. The apparatus of claim 7, wherein the voltage isolation device is a diode configured to prevent reverse current flow through the initiator, enhancing circuit safety.

* * * * *